US010196885B2

(12) United States Patent
Sharma et al.

(10) Patent No.: US 10,196,885 B2
(45) **Date of Patent: *Feb. 5, 2019**

(54) DOWNHOLE INDUCTION HEATER FOR OIL AND GAS WELLS

(71) Applicant: The Board of Regents of The University of Texas System, Austin, TX (US)

(72) Inventors: Mukul M. Sharma, Austin, TX (US); Raymond C. Zowarka, Austin, TX (US); Siddharth Pratap, Orange, CA (US)

(73) Assignee: Board of Regents of the University of Texas System, Austin, TX (US)

( * ) Notice: Subject to any disclaimer, the term of this patent is extended or adjusted under 35 U.S.C. 154(b) by 320 days.

This patent is subject to a terminal disclaimer.

(21) Appl. No.: 15/042,771

(22) Filed: Feb. 12, 2016

(65) Prior Publication Data

US 2016/0265325 A1 Sep. 15, 2016

(51) Int. Cl.

| | |
|---|---|
| ***E21B 43/24*** | (2006.01) |
| ***E21B 37/00*** | (2006.01) |
| ***E21B 43/12*** | (2006.01) |
| ***H05B 6/62*** | (2006.01) |
| ***E21B 36/04*** | (2006.01) |
| ***H05B 6/10*** | (2006.01) |

(52) U.S. Cl.

CPC ..... *E21B 43/2401* (2013.01); *E21B 36/04* (2013.01); *E21B 37/00* (2013.01); *E21B 43/121* (2013.01); *H05B 6/108* (2013.01); *H05B 6/109* (2013.01); *H05B 6/62* (2013.01); *H05B 2214/03* (2013.01)

(58) Field of Classification Search

CPC ..... E21B 36/04; E21B 37/00; E21B 43/121; E21B 43/2401; H05B 2214/03; H05B 6/108; H05B 6/109; H05B 6/62

See application file for complete search history.

(56) References Cited

U.S. PATENT DOCUMENTS 5,070,533 A * 12/1991 Bridges ..... E21B 36/04 166/60

5,465,789 A * 11/1995 Evans ..... E21B 43/2401 166/248

(Continued)

FOREIGN PATENT DOCUMENTS

WO 2010/114180 10/2010

OTHER PUBLICATIONS

International Search Report/Written Opinion for PCT Application No. PCT/US2016/017749 dated Apr. 22, 2016.

*Primary Examiner* — Robert E Fuller
*Assistant Examiner* — Christopher J Sebesta
(74) *Attorney, Agent, or Firm* — Meyertons, Hood, Kivlin, Kowert & Goetzel, P.C.; Mark R. DeLuca

(57) ABSTRACT

Described herein are methods and system that use electromagnetic heating to heat wellbores and the fluids therein. The heating is achieved by placing one or more permanent magnets in the wellbore and moving a metallic component and/or the one or more permanent magnets relative to each other. This generates eddy currents in the metallic component, which heat the metallic component. This heat is transferred to the fluids in the wellbore from the metallic component by convection.

11 Claims, 13 Drawing Sheets

(56) References Cited

U.S. PATENT DOCUMENTS

| | | | | |
|---|---|---|---|---|
| 6,011,245 | A * | 1/2000 | Bell | F24J 3/00 219/629 |
| 6,285,014 | B1 * | 9/2001 | Beck | E21B 36/04 166/248 |
| 6,297,484 | B1 | 10/2001 | Usui et al. | |
| 6,353,706 | B1 * | 3/2002 | Bridges | E21B 36/04 166/302 |
| 2009/0160445 | A1 * | 6/2009 | Hall | G01V 3/28 324/339 |
| 2010/0089574 | A1 * | 4/2010 | Wideman | E21B 7/14 166/272.1 |
| 2011/0272399 | A1 * | 11/2011 | Berdut-Teruel | H05B 6/108 219/672 |
| 2013/0192682 | A1 * | 8/2013 | Freese | F16L 55/00 137/13 |

* cited by examiner

DOWNHOLE INDUCTION HEATER FOR OIL AND GAS WELLS

PRIORITY CLAIM

This application claims priority to U.S. Provisional Application Ser. No. 62/115,513 entitled "DOWNHOLE INDUCTION HEATER FOR OIL AND GAS WELLS" filed Feb. 12, 2015, which is incorporated herein by reference in its entirety.

BACKGROUND OF THE INVENTION

1. Field of the Invention

The invention generally relates to methods of generating heat in oil or gas wells using electromagnetic heating.

2. Description of the Relevant Art

Hydrocarbons obtained from subterranean (e.g., sedimentary) formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations. Chemical and/or physical properties of hydrocarbon material in a subterranean formation may need to be changed to allow hydrocarbon material to be more easily removed from the subterranean formation. The chemical and physical changes may include in situ reactions that produce removable fluids, composition changes, solubility changes, density changes, phase changes, and/or viscosity changes of the hydrocarbon material in the formation. A fluid may be, but is not limited to, a gas, a liquid, an emulsion, a slurry, and/or a stream of solid particles that has flow characteristics similar to liquid flow.

A heat source may be used to heat a subterranean formation and/or the tubing and/or casing disposed in a wellbore. Electric heaters may be used to heat the subterranean formation by radiation and/or conduction and/or convection. An electric heater may resistively heat an element. U.S. Pat. No. 2,548,360 to Germain, which is incorporated by reference as if fully set forth herein, describes an electric heating element placed in a viscous oil in a wellbore. The heater element heats and thins the oil to allow the oil to be pumped from the wellbore. U.S. Pat. No. 4,716,960 to Eastlund et al., which is incorporated by reference as if fully set forth herein, describes electrically heating tubing of a petroleum well by passing a relatively low voltage current through the tubing to prevent formation of solids. U.S. Pat. No. 5,065,818 to Van Egmond, which is incorporated by reference as if fully set forth herein, describes an electric heating element that is cemented into a well borehole without a casing surrounding the heating element.

U.S. Pat. No. 6,023,554 to Vinegar et al., which is incorporated by reference as if fully set forth herein, describes an electric heating element that is positioned in a casing. The heating element generates radiant energy that heats the casing. A granular solid fill material may be placed between the casing and the formation. The casing may conductively heat the fill material, which in turn conductively heats the formation.

U.S. Pat. No. 4,570,715 to Van Meurs et al., which is incorporated by reference as if fully set forth herein, describes an electric heating element. The heating element has an electrically conductive core, a surrounding layer of insulating material, and a surrounding metallic sheath. The conductive core may have a relatively low resistance at high temperatures. The insulating material may have electrical resistance, compressive strength, and heat conductivity properties that are relatively high at high temperatures. The insulating layer may inhibit arcing from the core to the metallic sheath. The metallic sheath may have tensile strength and creep resistance properties that are relatively high at high temperatures.

All of these methods require that electrical power be transmitted hundreds of feet underground to provide power to the device. To run the electrical cables to the heating devices requires special connectors at the well head. In addition transformers and controllers are required at the surface to supply the underground power. The high cost of maintenance, and the difficulty in providing power hundreds of feet underground, makes other methods of providing heat to subterranean formations and tubing very desirable.

SUMMARY OF THE INVENTION

Embodiments described herein relate to systems and methods for generating heat in an oil or gas well using electromagnetic heating. The heating, in one embodiment, is accomplished by creating relative motion between a set of magnets and a conducting surface. The relative motion will induce eddy currents heating the conducting surface. The conducting surface may be thermally coupled to the wellbore to provide heating to the fluids travelling through wellbore. The energy needed to create the relative motion may be provided by the moving components of a downhole pump system.

In one embodiment, an electromagnetic heating system for heating the interior of a wellbore, includes: one or more permanent magnets coupled to a down-well component of the wellbore and a metallic component positioned within the wellbore and magnetically coupled to the one or more permanent magnets. During use the metallic component and/or the permanent magnets are moved in a manner such that a current is generated in the metallic component, causing the temperature of the movable magnetic component to increase.

In some embodiments, either the metallic component or one or more permanent magnets may be moved in a linear direction relative to each other. The metallic component and/or the one or more permanent magnets may be coupled to a pump, positioned within the wellbore, such that the reciprocating motion of the pump causes the metallic component and/or the one or more permanent magnets to move in a linear direction with respect each other.

In some embodiments, either the metallic component or the one or more permanent magnets may be rotated relative to each other. The metallic component and/or the one or more permanent magnets may be coupled to a pump, positioned within the wellbore, such that the reciprocating motion of the pump causes the metallic component and/or the one or more permanent magnets to move in a linear direction with respect each other. A drive mechanism may be coupled to the pump, wherein the drive mechanism translates the linear motion of the pump into rotational movement of the metallic component or the magnets.

In one embodiment, the one or more permanent magnets include a plurality of permanent magnets placed in a cylindrical or linear arrangement having alternately placed north-south poles. The one or more permanent magnets may be placed in a linear or cylindrical Halbach array.

In one embodiment the system includes a downhole motor coupled to the metallic components and/or the magnets, wherein the downhole motor moves the metallic component and/or the permanent magnets in a manner such that a current is generated in the metallic component.

In another embodiment, a drive mechanism is coupled to the metallic component and/or the permanent magnets, wherein the drive mechanism utilizes fluid pressures within the wellbore to move the metallic component and/or the permanent magnets in a manner such that a current is generated in the metallic component.

In another embodiment, a drive mechanism coupled to the metallic component and/or the permanent magnets, wherein the drive mechanism utilizes fluid velocities within the wellbore to move the metallic component and/or the permanent magnets in a manner such that a current is generated in the metallic component.

In one embodiment, the one or more permanent magnets are coupled to a tubing string of a downhole pump. In another embodiment, the one or more permanent magnets are magnetically coupled to a casing of a wellbore.

In an embodiment, a method of heating components within a wellbore comprises: placing an electromagnetic heating system as described above into a wellbore and moving the metallic component and/or the permanent magnets in a manner such that a current is generated in the metallic component.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
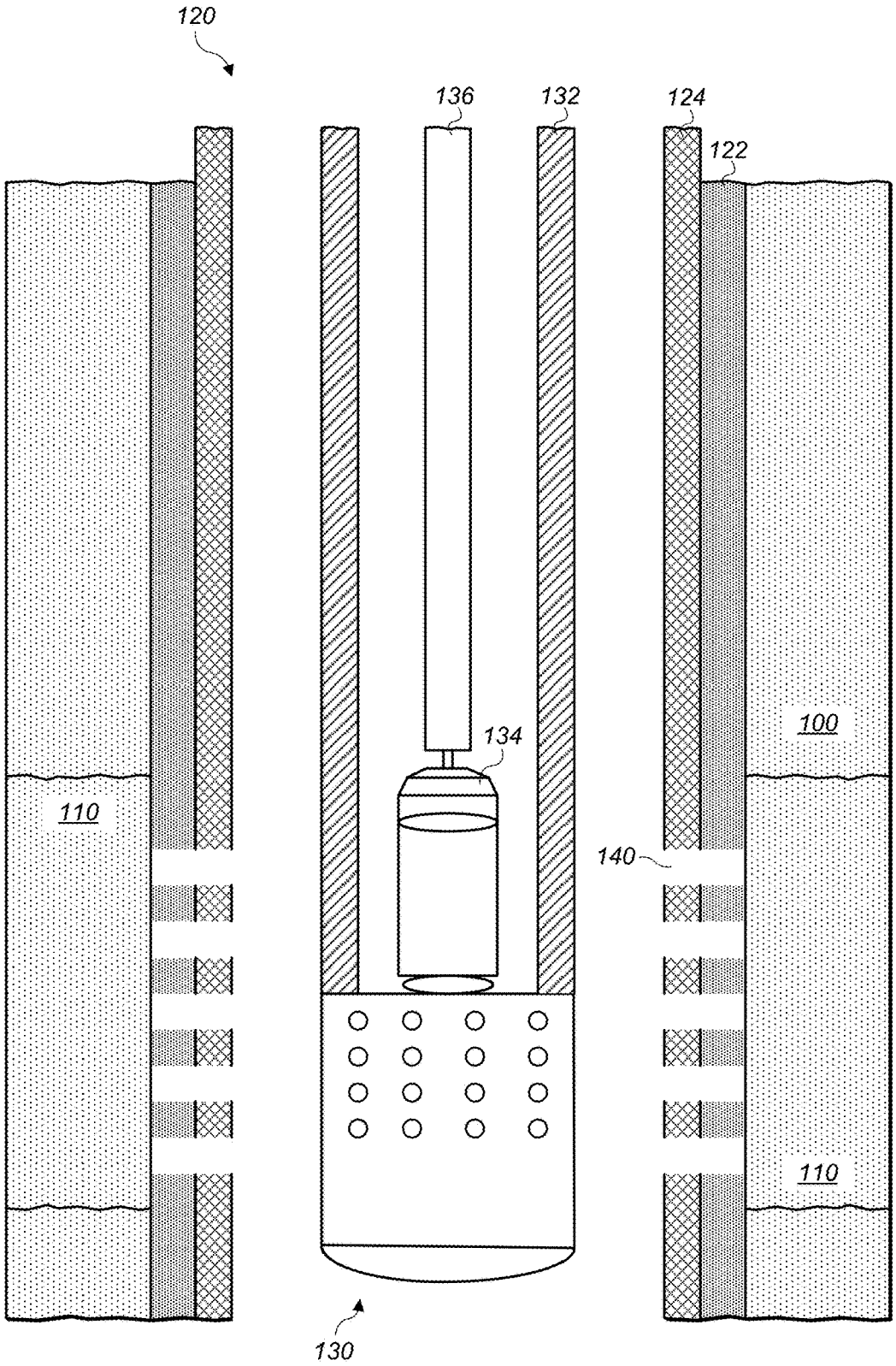
FIG. 1 depicts a typical hydraulic pump disposed in a casing within a subterranean formation.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

The following description generally relates to systems and methods for extracting hydrocarbons from subterranean formations.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

A "formation" includes one or more hydrocarbon containing layers, one or more non-hydrocarbon layers, an overburden, and/or an underburden. The "overburden" and/or the "underburden" include one or more different types of impermeable materials. For example, overburden and/or underburden may include rock, shale, mudstone, or wet/tight carbonate. In some embodiments of in situ conversion processes, the overburden and/or the underburden may include a hydrocarbon containing layer or hydrocarbon containing layers that are relatively impermeable and are not subjected to temperatures during in situ conversion processing that result in significant characteristic changes of the hydrocarbon containing layers of the overburden and/or the underburden. For example, the underburden may contain shale or mudstone, but the underburden is not allowed to heat to pyrolysis temperatures during the in situ conversion process. In some cases, the overburden and/or the underburden may be somewhat permeable.

"Formation fluids" and "produced fluids" refer to fluids removed from the formation and may include pyrolyzation fluid, synthesis gas, mobilized hydrocarbon, and water (steam). Formation fluids may include hydrocarbon fluids as well as non-hydrocarbon fluids. The term "mobilized fluid"

refers to fluids in a hydrocarbon containing formation that are able to flow as a result of thermal treatment of the formation.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

"Orifices" refer to openings (e.g., openings in conduits) having a wide variety of sizes and cross-sectional shapes including, but not limited to, circles, ovals, squares, rectangles, triangles, slits, or other regular or irregular shapes.

"Paraffin hydrocarbons" or "Paraffins" refer to any of the saturated hydrocarbons having the general formula $C_nH_{2n+2}$, C being a carbon atom, H a hydrogen atom, and n an integer greater than 15. Paraffins having more than 15 carbon atoms per molecule are generally solids at or about room temperature and can form solid deposits in wellbores as the produced fluid cools when being conveyed to the surface.

In an embodiment, systems and methods for generating heat in an oil or gas well using electromagnetic heating use a permanent magnet array to induce eddy currents to heat a moving metallic component such as a tubing string or a metallic cylinder. Electromagnetic heating can be used to prevent the deposition of paraffin or remove paraffin in oil wells or for heating up produced or injected fluids such as oil, water or gas.

Induction heating is generally produced by moving premanent magnets with respective to a conductive metal to generate eddy currents in the conductive metal, causing the temperature of the conductive metal to increase. The permanent magnets may be installed in many different ways. Some examples of permanent magnet arrays include:

1. Cylindrical arrangement of alternately placed north-south poles of permanent magnets.
2. A linear array of North—South poles of permanent magnets.
3. A cylindrical or linear Halbach array of magnets There are many methods for moving the metallic component relative to the permanent magnets. Some of these methods include:

1. Rotating a metallic cylinder inside or outside an array of magnets.
2. The linear motion of the metallic component or the magnets relative to each other.

There are many methods for moving the metallic components relative to the permanent magnets. Some of these methods include:

1. Using the motion of a sucker rod pump installed for artificial lift in the well.
2. Utilizing a downhole motor to drive the metallic components or the magnets in the rotary or linear motion.
3. Utilizing fluid pressures to move the magnets or the metallic components relative to each other.
4. Utilizing fluid velocities to move the magnets or metallic components relative to each other.

In one embodiment, an electromagnetic (EM) heater is integrated into a sucker rod assembly connected to a pump jack. The system and method is a modification of existing pumping equipment by adding an EM heat generation unit within the wellbore, but above the existing downhole pump. In this manner, fluids in the well above the downhole pump can be heated to keep the paraffin hydrocarbons in a liquid state or prevent paraffin from depositing in the wellbore tubing by keeping the temperature of the produced fluid above the cloud point of the produced fluid so that the paraffin rises with the produced fluid to the surface.

FIG. 1 depicts a typical hydraulic pump disposed in a casing within a subterranean formation. Subterranean formation 100 includes a hydrocarbon containing section 110 through which a wellbore 120 has been formed. Wellbore 120 includes a cement 122 encased casing 124 which leads into and/or through hydrocarbon containing section 110. A downhole pump includes tubing string 132 and downhole pump 134 coupled to sucker rod 136. In an embodiment, a down-hole pump has two ball check valves: a stationary valve at bottom called the standing valve, and a valve on the piston connected to the bottom of the sucker rods that travels up and down as the rods reciprocate, known as the traveling valve. Reservoir fluid enters from the formation into the bottom of the borehole through perforations 140 that have been made through the casing and cement.

When the rods at the pump end are traveling up, the traveling valve is closed and the standing valve is open. Consequently, the pump barrel fills with the fluid from the formation as the traveling piston lifts the previous contents of the barrel upwards. When the rods begin pushing down, the traveling valve opens and the standing valve closes. The traveling valve drops through the fluid in the barrel (which had been sucked in during the upstroke). The piston then reaches the end of its stroke and begins its path upwards again, repeating the process.

In an embodiment, existing pumping systems may be modified by using a permanent magnet array to induce eddy currents to heat a moving metallic component such as a tubing string or a metallic cylinder coupled to the tuning string. This could be used to prevent the deposition of paraffin or remove paraffin in oil wells or for heating up produced or injected fluids such as oil, water or gas. It would be advantageous to integrate the EM heater into a sucker rod assembly connected to a pump jack. The method involves modifying the existing pumping equipment (e.g., the typical system depicted in FIG. 1) by adding an EM heat generation unit above the existing pump. In this manner, fluids may be heated in the well above the pump to remove the paraffin or prevent it from forming by keeping the oil temperature above the cloud point of the oil so that is flows with the oil to the surface.

Figure 2:
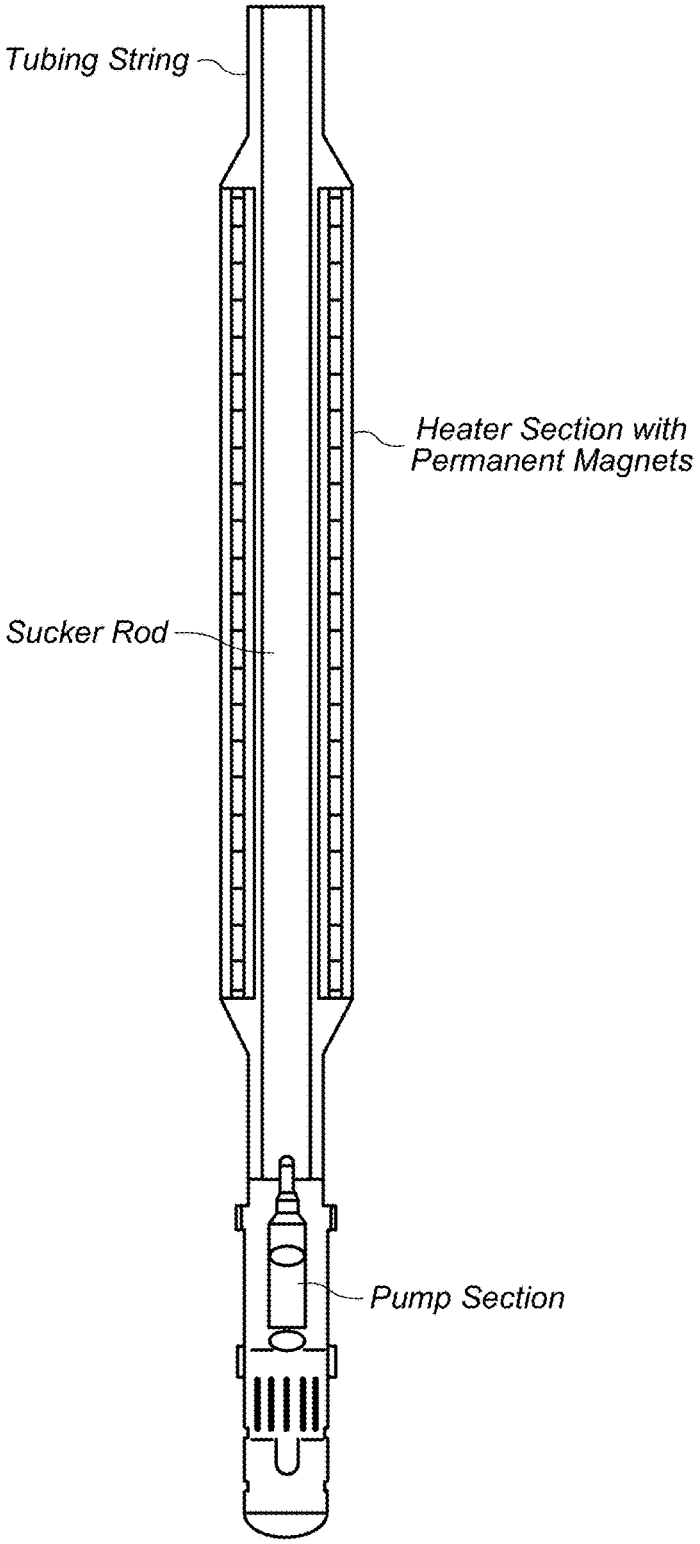
FIG. 2 depicts a schematic drawing of an electromagnetic heater coupled to a tubing string and a down-hole pump.
Figure 2A:
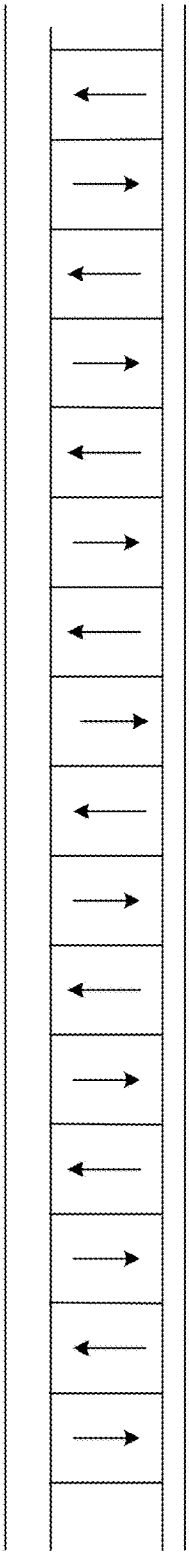
FIG. 2A depicts an exploded view of the permanent magnets of the schematic diagram of FIG. 2, with the permanent magnets in a linear arrangement having alternately placed north-south poles.
Figure 2B:
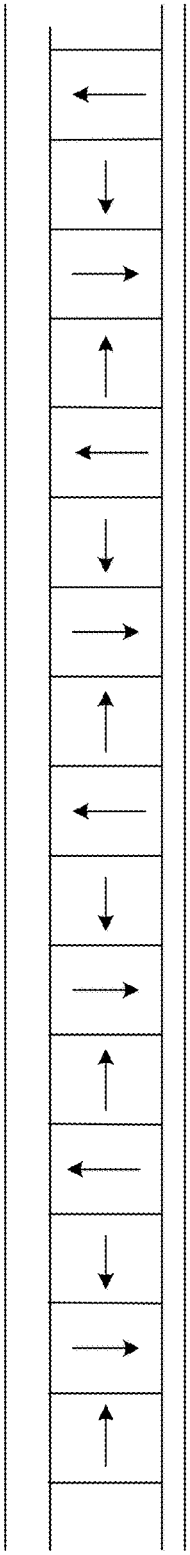
FIG. 2B depicts an exploded view of the permanent magnets of the schematic diagram of FIG. 2, with the permanent magnets in a linear Halbach array.

A drawing of an EM heater coupled to a tubing string and a down-hole pump is depicted in FIG. 2. The EM heater uses a conducting drum that rotates with respect to permanent magnets coupled (e.g., via an epoxy resin) to the surface of the stationary tubing string. FIG. 2A depicts an exploded view of the permanent magnets of the schematic diagram of FIG. 2, with the permanent magnets in a linear arrangement having alternately placed north-south poles. FIG. 2B depicts an exploded view of the permanent magnets of the schematic diagram of FIG. 2, with the permanent magnets in a linear Halbach array.

Figure 3:
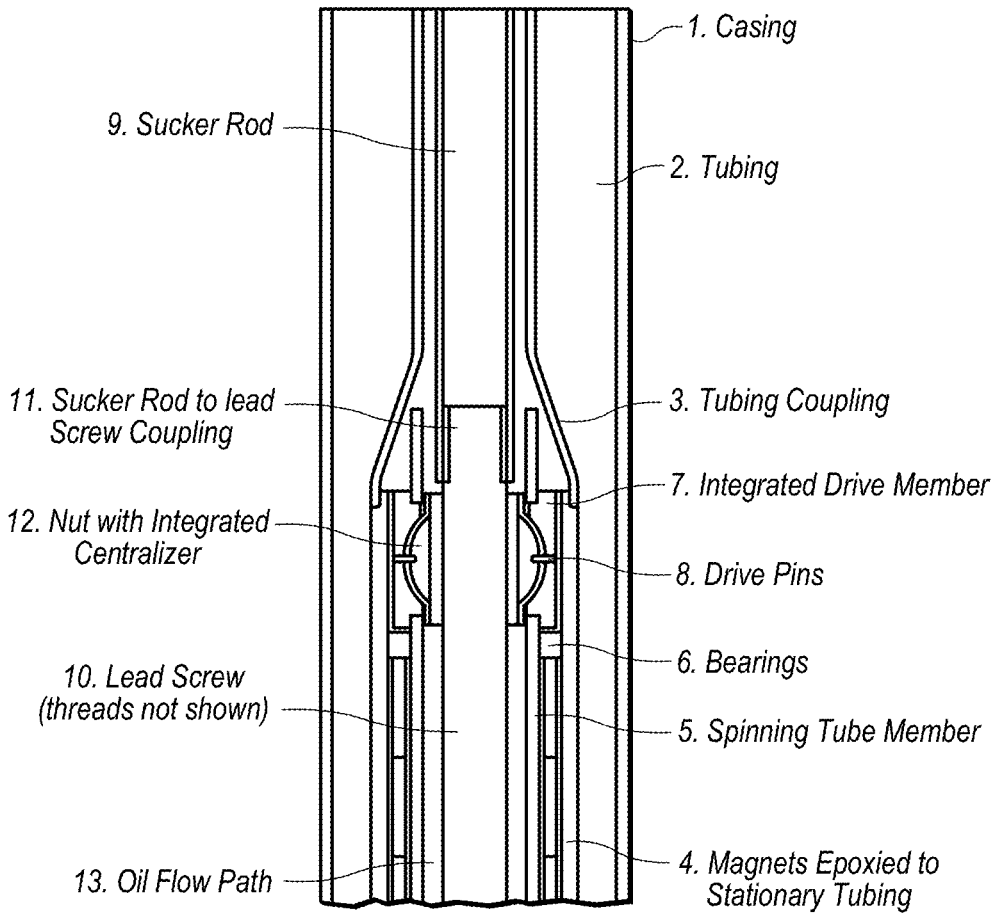
FIG. 3 depicts a detailed cross section of a downhole electromagnetic heater assembly.

FIG. 3 shows a detailed cross section of a downhole EM heater assembly. . The EM heater assembly installs in the well casing (1) like any other tubing joint (2). A coupling connects the larger tubing of the heater to the tubing string of the well (3). Permanent magnets are connected to the inner wall of the heater tubing in a regular or Halbach array pattern (4). The spinning tube member (5) that will be heated by eddy currents is mounted inside the heater tubing on bearings (6). There is an integrated drive member (7) welded to the spinning tube and equipped with drive pins (8). The sucker rod (9) and pump (not shown) are lowered into the well in normal fashion. The joint of the sucker rod that resides at heater depth is actually a lead screw (10) that couples to the sucker rod with a standard coupling (11). The lead screw is equipped with a nut that has an integrated centralizer (12). As the sucker is lowered through the heater section of tubing the centralizer springs snaps into pocket of the integrated drive member and straddles the drive pins. As the sucker rod moves up and down the nut now trapped in the drive member with the force of the centralizer springs spins and applies force to the rotating tube via the drive pins. As oil flows (13) through the spinning tube it is heated to prevent the formation of paraffin. When it comes time to extract the pump the nut runs to the end of the lead screw and stops. Sufficient force is then applied to the centralizer to collapse the springs into the stationary tubing string and the sucker string and pump are removed from the well.

The time change of the magnetic field within the tubing causes the electromagnetic heating. Typical tubing diameters found in the literature are 2⅜" (6 cm), 2⅞" (7.5 cm), and 3½" (9 cm). It would be advantageous, but not necessary, to select the larger tubing size for the heater section because the heat generation is proportional to surface area.

Several designs may be used to produce electromagnetic heating. In one embodiment, a system from producing electromagnetic heating is based on linear motion of magnets. Alternatively, electromagnetic heating can be produced by rotational motion of magnets. While it was found that the linear motion of the magnets relative to the stationary component generated less heat than a rotational arrangement, wither arrangement can be used.

In a preferred embodiment, a metal component is rotated relative to a ring of permanent magnets to generate heat in the metal component. This embodiment utilizes a mechanical feature that converts the linear motion of the pump to rotary motion. For example, in one embodiment, a ball screw or a lead screw may be used to convert linear motion to rotary motion. With this technique the rotational surface speed of the metallic drum (relative to the magnets) can be increased over that produced by the linear motion of the pump jack. This increase in speed leads to an increase in eddy current heating.

Figure 4:
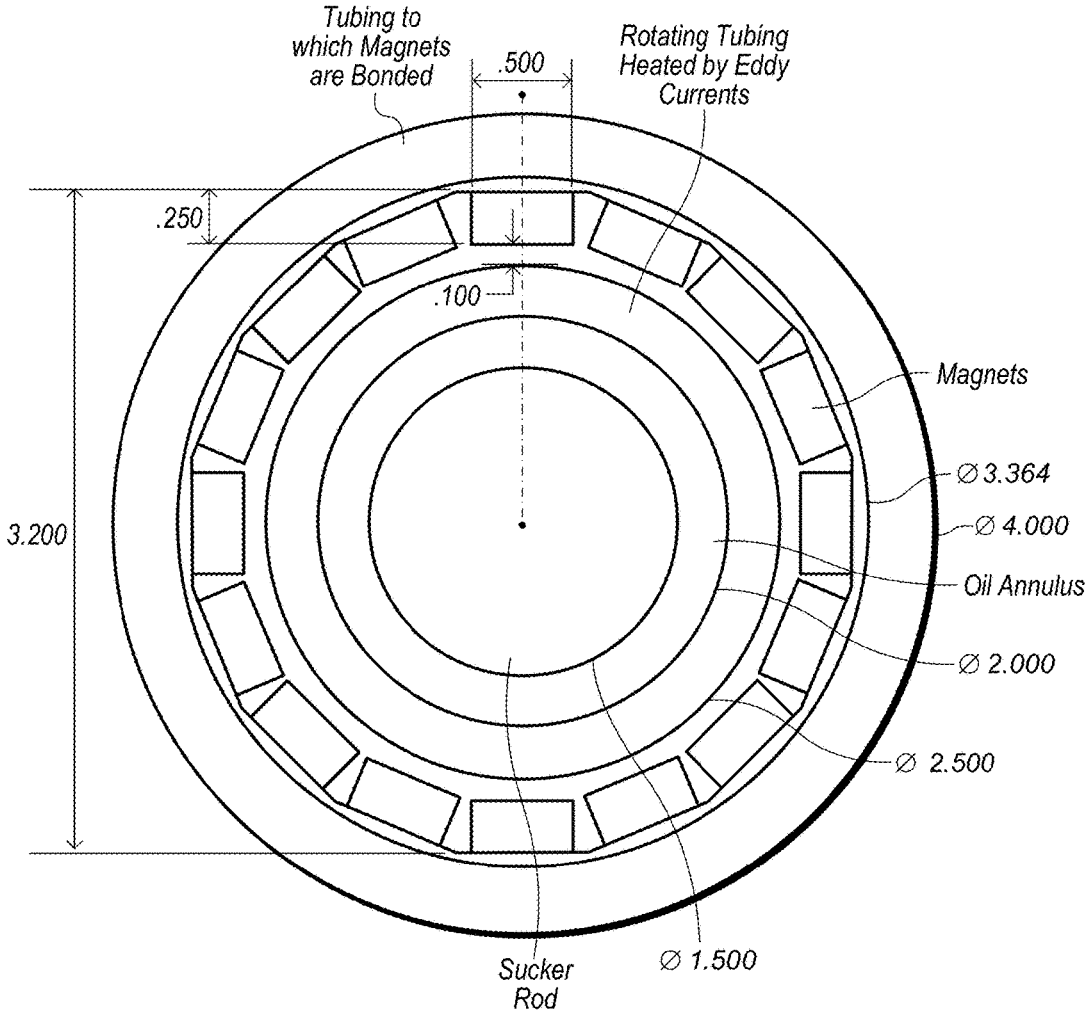
FIG. 4 depicts a cross-sectional top view of the electromagnetic heater section.

In one embodiment, depicted in FIGS. 2-4, the relative motion between the permanent magnets and the metallic component is accomplished by rotating a metallic cylinder within a ring of permanent magnets. This induces eddy currents in the metal component. The linear pumping motion of the pump is converted to rotary motion of the permanent magnet rotor utilizing a simple screw device with an integrated drive. (FIG. 3). The screw is pitched to allow a desired number of revolutions (for example 50 revolutions) of the device on the upstroke of the pump jack. This translates into a rotary motion of up to about 600 rpm.

In an exemplary application of a lead or ball screw, the screw is rotated to provide linear motion of the nut. In this embodiment, the screw, as part of the sucker rod, is driven through the nut and the nut spins a clutch mechanism that will then engage and rotate the drum (See FIG. 3).

FIG. 4 depicts a cross-sectional top view of the electromagnetic heater section. In this embodiment, the heater utilizes planar permanent magnets built into a section of well tubing. The conducting tube is rotated by a specialized coupling that converts linear motion of the sucker rod to rotary motion of the tube. The rotor with permanent magnets installed in slots rotates inside the casing to introduce eddy currents in the rotating metal cylinder and provide the thermal heating. Oil flows between the sucker rod and the rotating tube and is heated by the eddy current losses in the tube.

Figure 5:
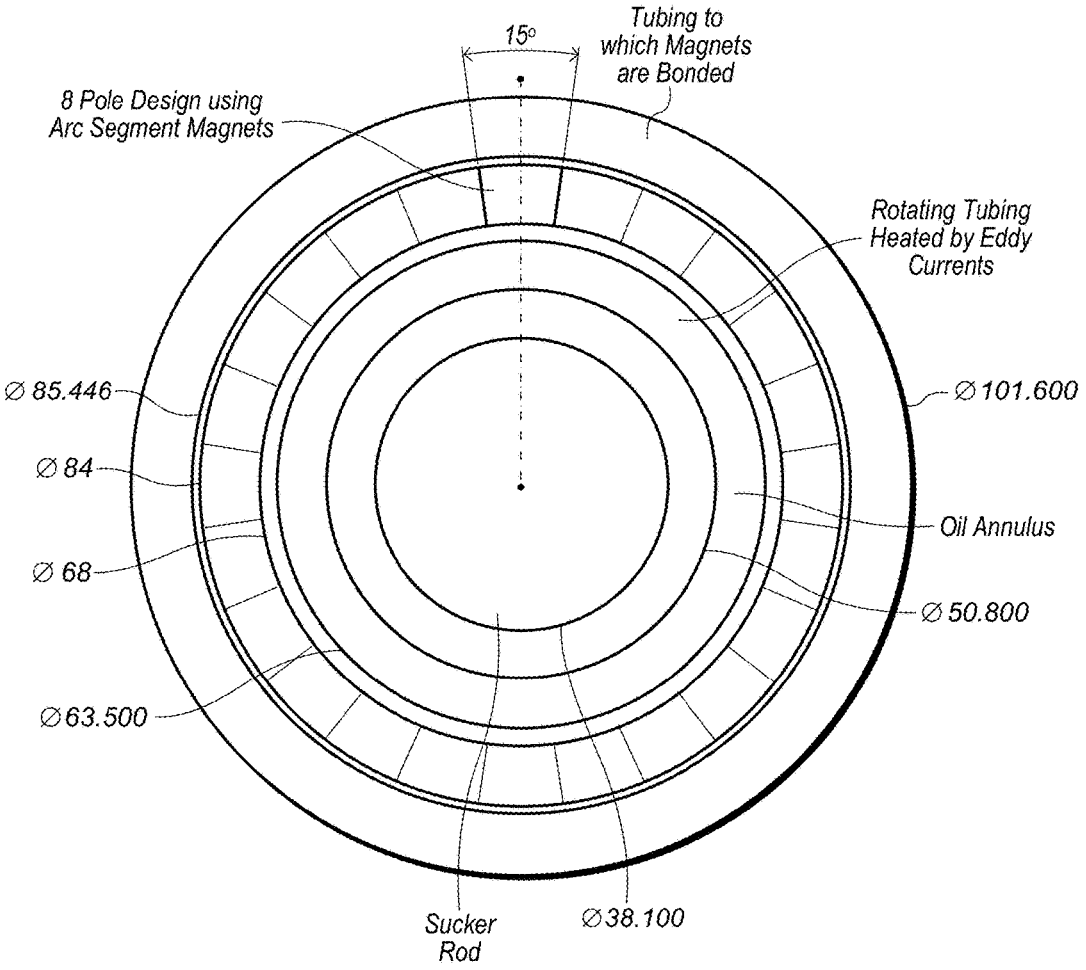
FIG. 5 depicts an alternate embodiment of an electromagnetic heating system.
Figure 5A:
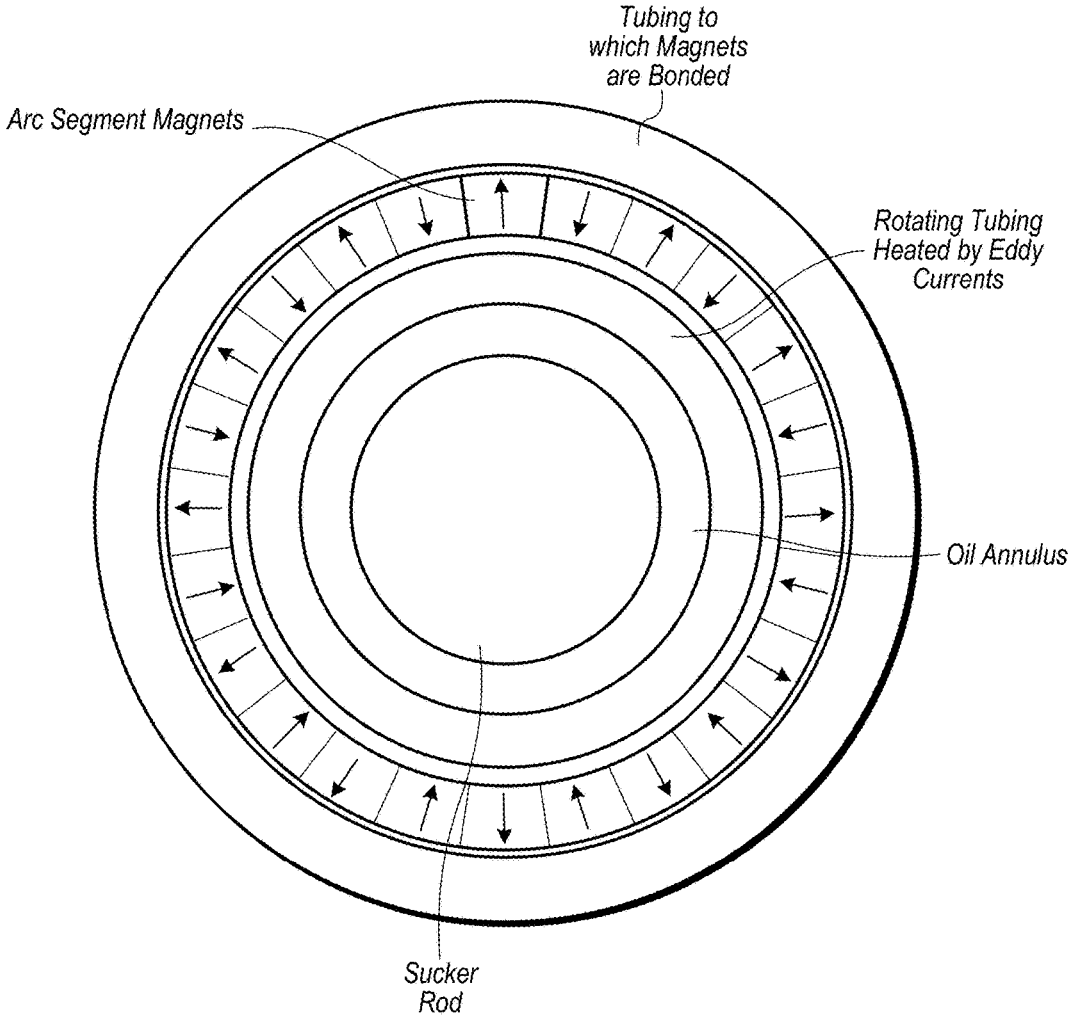
FIG. 5A depicts an schematic diagram of the electromagnetic heating system of FIG. 5 with the permanent magnets placed in a cylindrical arrangement having alternately placed north-south poles.
Figure 5B:
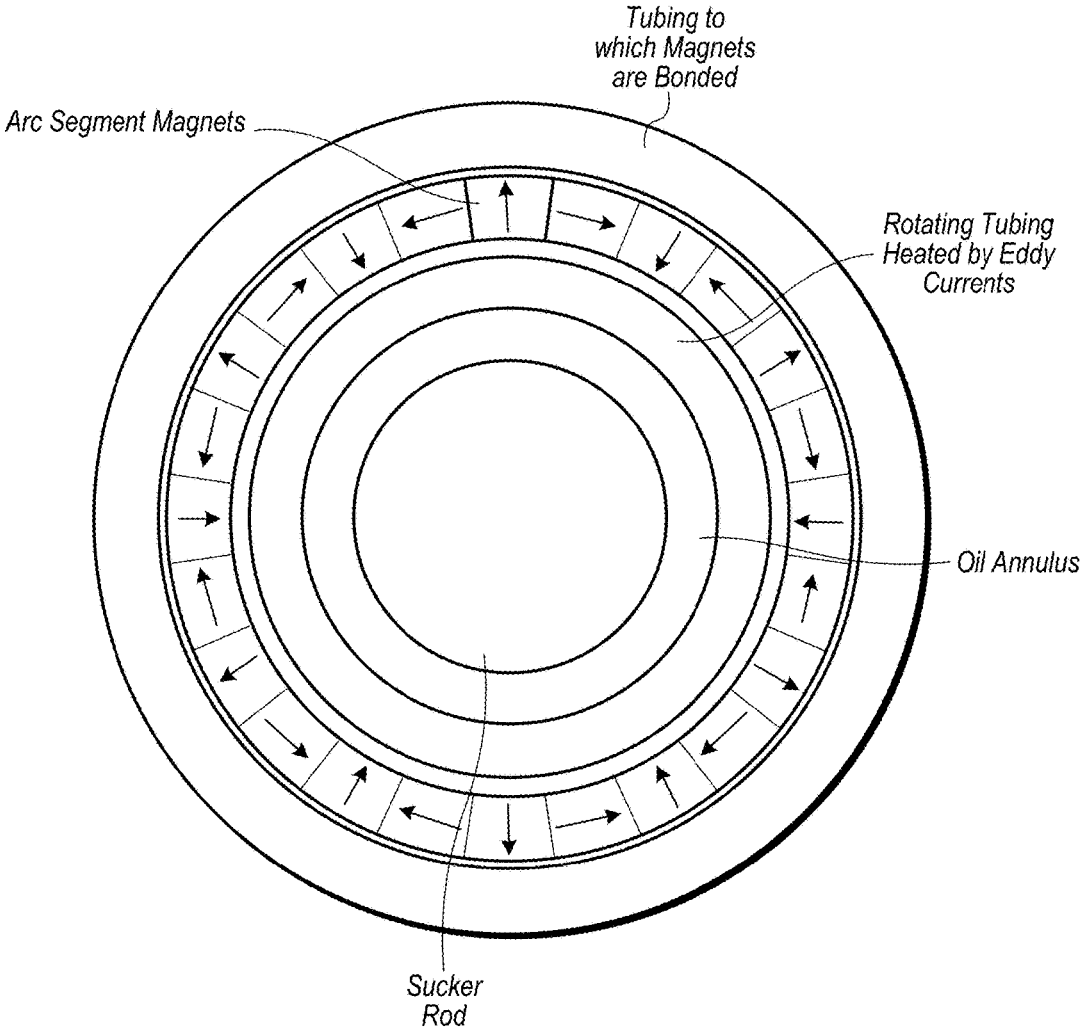
FIG. 5B depicts an schematic diagram of the electromagnetic heating system of FIG. 5 with the permanent magnets placed in a cylindrical arrangement in a linear Halbach array.

An alternate embodiment of an electromagnetic heating system is depicted in FIG. 5. In this embodiment, the magnets are curved to concentrate the magnetic field. The concentration in flux in the rotating conductor produces increased power loss and heating with respect to the planar magnet design depicted in FIG. 4. In one embodiment, shown in FIG. 5A, the permanent magnets may be placed in a cylindrical arrangement having alternately placed north-south poles. In an alternate embodiment, shown in FIG. 5B, the permanent magnets may be placed in a cylindrical arrangement in a linear Halbach array.

The expected heat generation is now increased to 10.4 kW per meter. In addition the circumferential and radial magnetic fields do not interfere as much lowering the possibility of demagnetization. This design increases the number of poles, raising the operating frequency and therefore the eddy current generation. The ability to produce more peak power is important because the sinusoidal motion of the pump lowers the average power of the device. The ability to produce 13.4 kW of average power in a 100 inch stroke demonstrates, however, that the device can inhibit paraffin formation.

Figure 6:
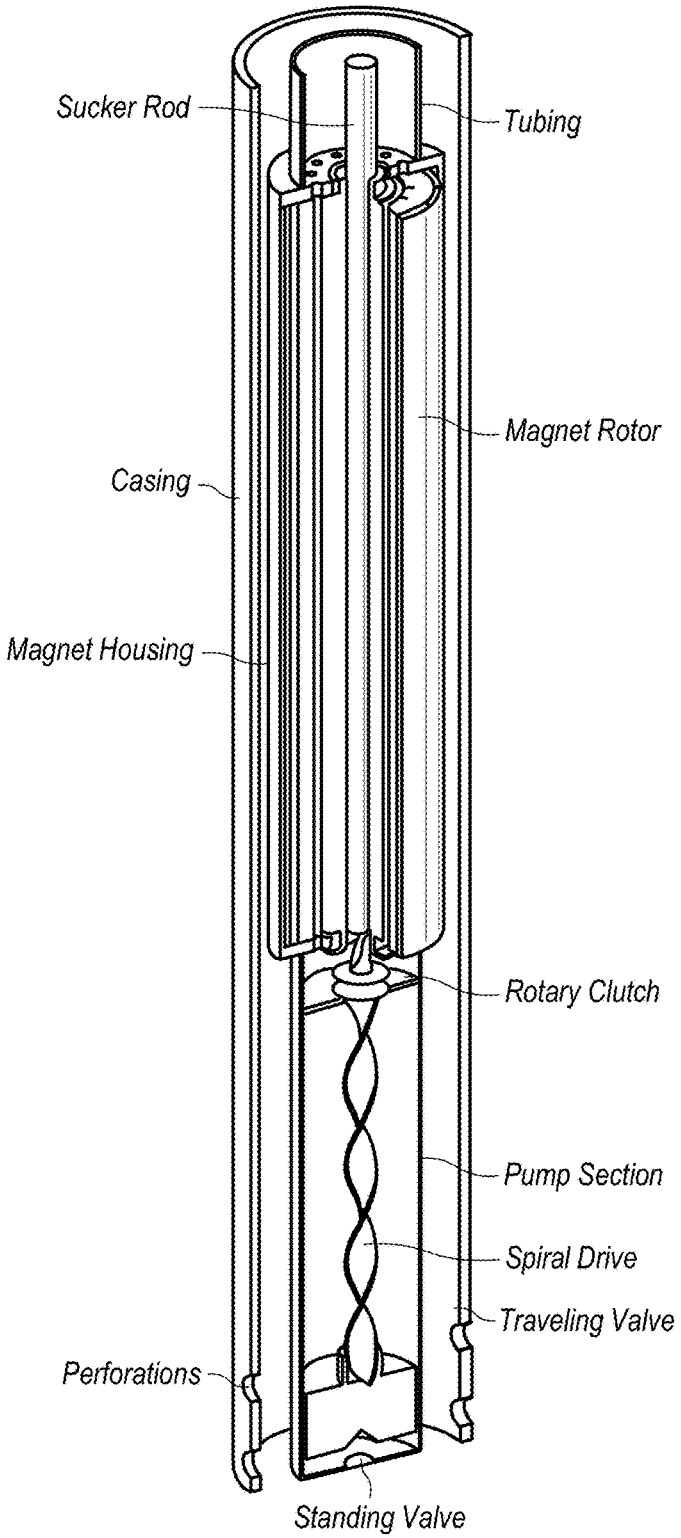
FIG. 6 depicts an embodiment of an electromagnetic heating system configured to heat the casing of a wellbore.

There are other oilfield applications where an electromagnetic heater may be advantageously employed. An example of two such applications would be heavy oil recovery and hydrate plug removal in gas wells. For these applications there may be an advantage to heat the casing. FIG. 6 depicts an embodiment, which may be used to heat the casing. In this embodiment, the magnets rotate in a composite extension of the well tubing to create an electric field in the casing.

The proposed downhole induction heating method has the following key advantages.

1. The heat is delivered locally and at a depth that can be selected by the user. This implies that it is not necessary to heat the entire wellbore as is usually the case with heaters placed on the surface. This can result in significant energy savings.
2. The embodiments of this system do not necessarily require any electrical connections to be provided downhole. This can result in significant capital savings for both installation and maintenance.
3. Some embodiments of this method can be integrated into the existing wellbore architecture i.e. connected to the tubing or pump directly. This implies that the method can be used for existing wells very minor changes to the existing hardware.
4. The proposed method can be used in conjunction with existing pumping equipment such as sucker rod pumps and electrical submersible pumps.
5. If the downhole heater is used to heat water for injection into the reservoir, placing the induction heaters close to the bottom of the well provides us with the following advantages:
   a. No electrical cables need to be lowered into the well (as would be the case with downhole electrical heaters.
   b. The risk of hot-spots and localized overheating is minimized.
   c. The heat loss from the well to the surrounding rock as the hot fluid travels from the surface to the bottom of the well is eliminated or substantially reduced. This eliminates the need for wellbore thermal insulation. It implies that steam injection can be pratically applied to deeper formations (which otherwise is not attempted due to wellbore heat losses).

d. Only the bottom of the well is subjected to the high temperature and this drastically reduces corrosion rates and prevents other high temperature reactions from occurring in the well. The use of corrosion inhibitors is reduced and damage to the wellbore steel is also reduced significantly.

e. Less expensive steel can be used to construct most of the well. Only the portion of the well where the heater is located needs to be constructed of metals that can withstand high temperatures for extended periods of time.

To show that the electromagentic heaters described herein can be used to remove paraffin from wells, the system was modeled and the model used to determine the heat generated. It is assumed that the downhole induction heater is being driven by a sucker rod pump. As stated elsewhere in this patent application this is one of many embodiments of the proposed method. To estimate the amount of heat needed to remove paraffin from oil wells the following assumptions were made.

The pump jack makes 6 strokes/min (this is an up and a down)

The stroke length is 200" (the screw length would be 100")

1200"/min

100'/min 1.67'/sec 0.51 m/sec

Heat capacity of water:

$$C_p = 4.18 \frac{\text{kJ}}{\text{kg}^\circ\ \text{K}}$$

Heat capacity of oil:

$$C_p = 2.09 \frac{\text{kJ}}{\text{kg}^\circ\ \text{K}}$$

Assume desired flow is:

$$50 \frac{\text{bbl}}{\text{day}} \text{ of water } 50 \frac{\text{bbl}}{\text{day}} \text{ of oil}$$

Power required to raise water 25 C:

$$P = \frac{50\ \text{bbl}}{\text{day}} \frac{159\ \text{l}}{\text{bbl}} \frac{1\ \text{kg}}{\text{l}} \frac{\text{day}}{86{,}400\ \text{s}} \frac{4.18\ \text{kJ}}{\text{kgK}} 25\ \text{K} = 9.61\ \text{kW}$$

Power required to raise oil 25 C:

$$P = \frac{50\ \text{bbl}}{\text{day}} \frac{159\ \text{l}}{\text{bbl}} \frac{0.8\ \text{kg}}{\text{l}} \frac{\text{day}}{86{,}400\ \text{s}} \frac{2.09\ \text{kJ}}{\text{kgK}} 25\ \text{K} = 3.8\ \text{kW}$$

Approximate total power requirement is 13.4 kW.

Based on the design presented in this patent this would require a magnetic array that is approximately 1 to 2 m long (depending on the diameter of the well).

It is understood that the formation fluid will change well to well and the calculation above is only an example. Similarly the design parameters for the heater allow the device to be tuned to the given well requirements. For example if the cooling effect of subsurface water is causing paraffin formation at multiple locations more than one device can be place in the well at desired depths to increase the temperature of the fluid. If the mixture of fluid constituents and pumping rate require a different input power then the length of the rotary heating tube can be adjusted to produce the required power. Additionally the lead of the screw can be changed to adjust the rotary speed of the device and because induction heat is proportional to the rotary speed squared the power is easily tuned. If the reservior is of particularly high temperature the magnet type can be changed with an associated reduction in magnetic field but the power delivery can be maintained by adjusting the speed of the device or the length of the rotary member. These are just a few examples of the design parameters that can be adjusted to achieve formation fluid recovery under specified conditions.

A similar calculation can be done for injection wells where hot-water or steam injection into the reservoir is desired. For example if 100 bbl of water per day needs to be injected into the well and the temperature needs to be increased by 125 C at the bottom of the well, the heat needed would be approximately 120 kW. Based on the design presented herein this would require a heater that is approximately 5 to 10 m long (depending on the diameter of the well).

While the above description has focused on the use of electromagnetic heating for downhole heating applications, it should be understood that the same devices can be used for surface heating applications. In one embodiment, the devices described herein may be modified for use on surface flow lines as well as surface and near surface production lines. Surface, and near surface, electromagnetic heating systems can be used, for example, to prevent paraffin deposition in surface flow lines.

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 7:
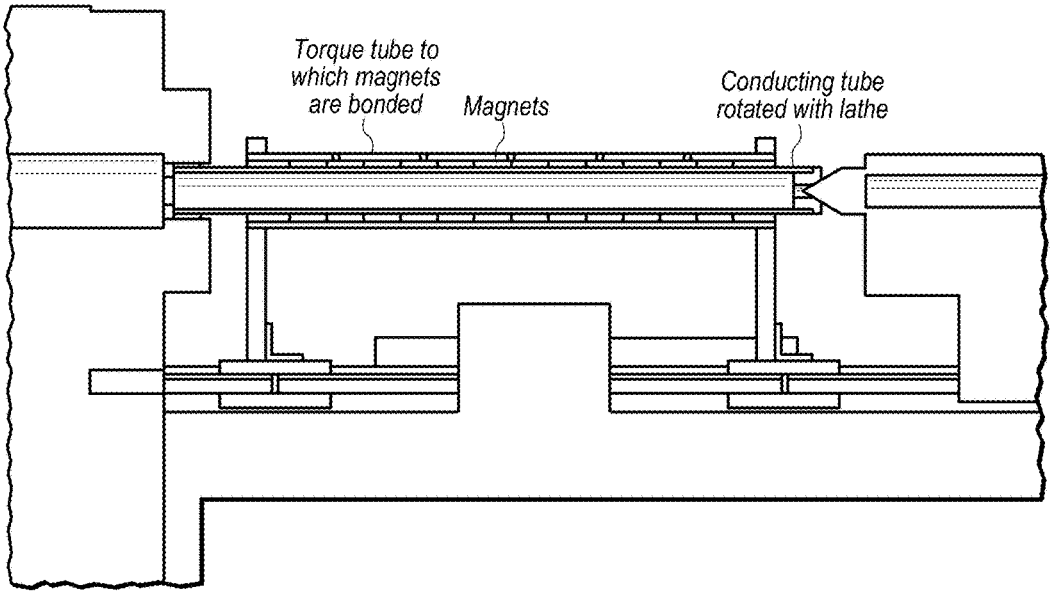
FIG. 7 shows a schematic diagram of a prototype device.

A prototype device was built and measurements made on this prototype device are presented and shown to agree well with the simulation results. FIG. 7 shows a schematic of the prototype device. In this experiment the torque tube to which the magnets are mounted is free to rotate on low loss bearings. The conducting tube is spun by the lathe and eddy currents are induced in the tube. The lathe is turned at constant speed and by measuring the torque on the torque tube the power generated by eddy currents can be calculated.

Figure 8:
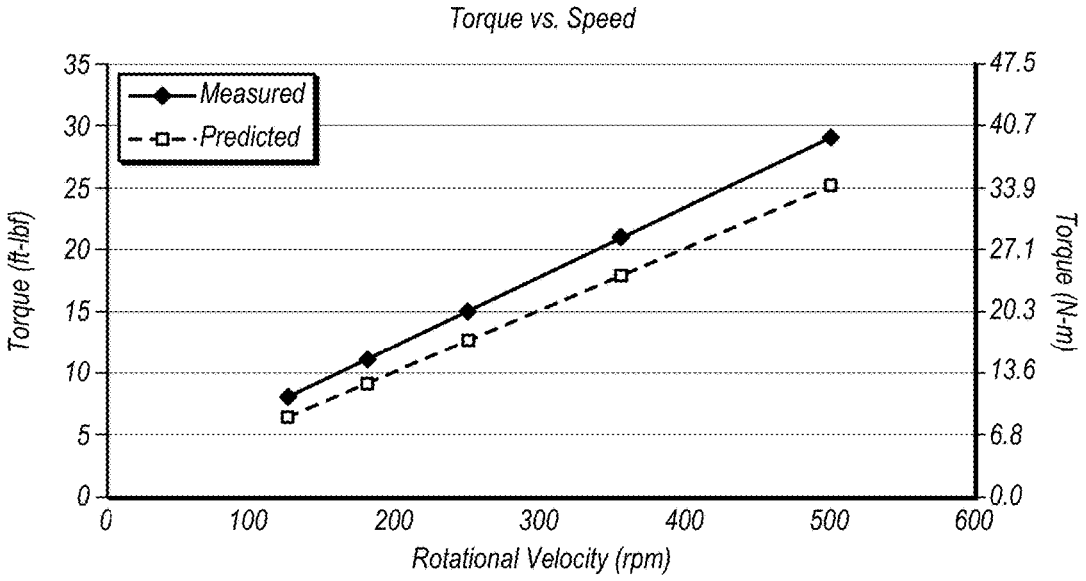
FIG. 8 depicts a graphical comparison of generated by the spinning motion of the prototype device of FIG. 7 compared with the computed torque.

Tests were conducted on the device by spinning it in a lathe at different rotational speeds and measuring the temperature of the assembly after different times of rotation. The torque generated by the spinning motion was also measured and compared with the computed torque, FIG. 8. This is a more direct measure of the electromagnetic work being done and converted to heat in the metal component. The experimental results overpredict the model results because a higher conductivity material was used in the experiment for the spinning tube.

Figure 9:
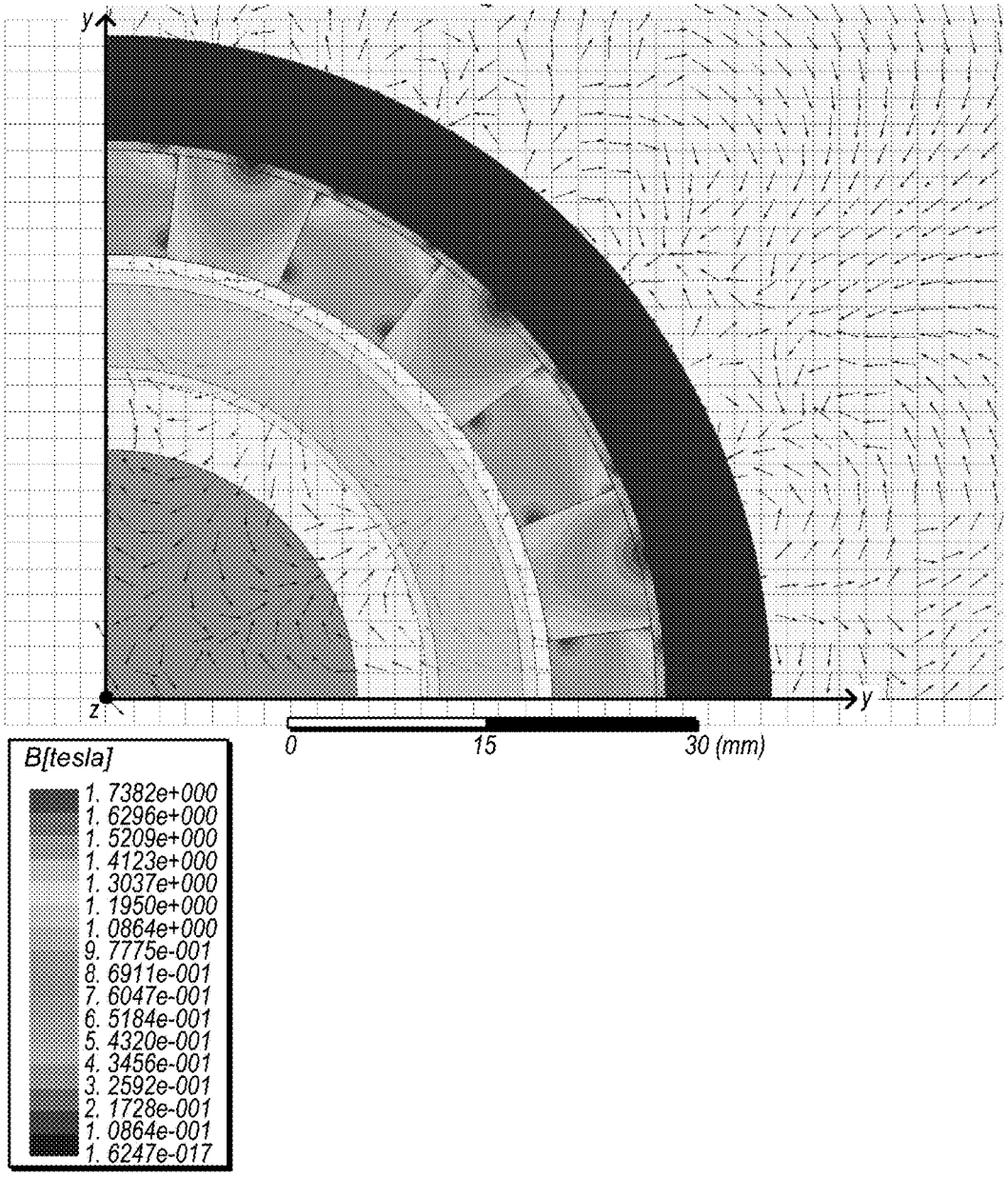
FIG. 9 depicts the magnetic flux generated in the device.

To estimate the heat generated by the proposed induction heater, simulation models were built to compute the extent of heating that may be expected with different configurations of permanent magnets and metal components moving relative to the magnets. An electromagnetic simulator was used to numerically simulate the heat generated by the preferred embodiment. The results of this simulation are depicted in FIG. 9. In addition to the electromechanical modeling, a thermal model was built to estimate the temperature increase caused by the induction heater. Both these models were run for different configuration of magnets and the moving metallic component as well as fluid velocities in the annulus.

Figure 10:
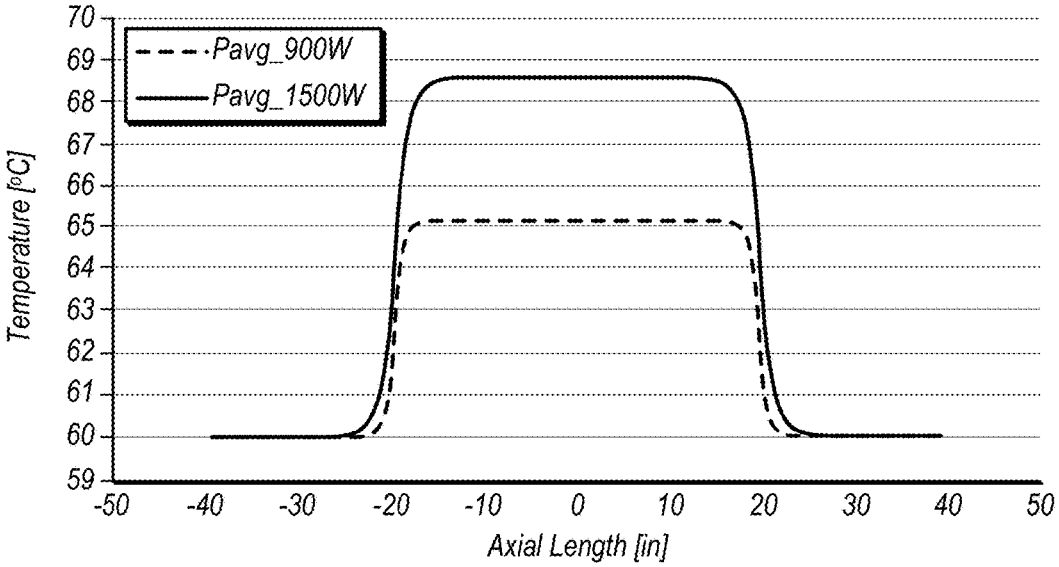
FIG.10 depicts the results of a simulation of induction heating in a well bore.

Of importance is the ability of the spinning heated tube to heat the oil. Under steady state conditions the rise in temperature of the surface of the heater tube with a mixture of 50 bbl/day of oil and 50 bbl/day of brine flowing over the tube surface is shown in FIG. 10. The heater may be placed in the tubing string at different locations to boost the temperature of the pumped fluid to keep it above the cloud point of paraffin.

***

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An electromagnetic heating system for heating a wellbore and the fluids therein, comprising:

one or more permanent magnets coupled to a down-well component of the wellbore;

a metallic component positioned within the wellbore and magnetically coupled to the one or more permanent magnets, wherein the metallic component is coupled to a pump positioned within the wellbore; and a drive mechanism coupled to the pump, wherein the drive mechanism translates the reciprocating motion of the pump into rotational movement of the metallic component such that the metallic component rotates with respect to the one or more permanent magnets;

wherein, during use, the movement of the metallic component with respect to the one or more permanent magnets generates a current in the metallic component, causing the temperature of the wellbore and the fluids therein to increase.

2. The system of claim 1, wherein the one or more permanent magnets comprises a plurality of permanent magnets placed in a cylindrical arrangement having alternately placed north-south poles.

3. The system of claim 1, wherein the one or more permanent magnets comprises a plurality of permanent magnets placed in a Halbach array.

4. The system of claim 1, wherein the one or more permanent magnets comprises a plurality of permanent magnets placed in a linear arrangement having alternately placed north-south poles.

5. The system of claim 1, wherein the one or more permanent magnets are coupled to a tubing string of a downhole pump.

6. The system of claim 1, the one or more permanent magnets are magnetically coupled to a casing of a wellbore.

7. The system of claim 1, wherein the drive mechanism comprises a ball screw assembly.

8. The system of claim 1, wherein the drive mechanism comprises a ball screw assembly.

9. The system of claim 1, wherein the drive mechanism translates the reciprocating movement of rods connected to the pump into rotational movement of the metallic component.

10. A method of heating components and fluids within a wellbore comprising:

placing a pump comprising an electromagnetic heating system into a wellbore; wherein the electromagnetic heating system comprises:

one or more permanent magnets coupled to a down-well component of the wellbore;

a metallic component positioned within the wellbore and magnetically coupled to the one or more permanent magnets, wherein the metallic component is coupled to the pump; and a drive mechanism coupled to the pump, wherein the drive mechanism translates the reciprocating motion of the pump into rotational movement of the metallic component such that the metallic component rotates with respect to the one or more permanent magnets;

reciprocating the pump within the wellbore, wherein the drive mechanism translates the reciprocating motion of the pump into rotational movement of the metallic component such that the metallic component rotates with respect to the one or more permanent magnets, and where rotational movement of the metallic component with respect to the one or more permanent magnets generates a current in the metallic component causing the temperature of the wellbore and the fluids therein to increase.

11. An electromagnetic heating system for heating a wellbore and the fluids therein, comprising:

one or more permanent magnets coupled to a coupled to a pump positioned within the wellbore;

a metallic component positioned within the wellbore and magnetically coupled to the one or more permanent magnets; and a drive mechanism coupled to the pump, wherein the drive mechanism translates the reciprocating motion of the pump into rotational movement of the one or more permanent magnets such that the one or more permanent magnets rotate with respect to the Metallic component;

wherein, during use, the movement of the one or more permanent magnets with respect to the metallic component generates a current in the metallic component, causing the temperature of the wellbore and the fluids therein to increase.

* * * * *